US005147772A

United States Patent [19]

Tsaur et al.

[11] Patent Number: 5,147,772

[45] Date of Patent: Sep. 15, 1992

[54] PROCESS OF PREPARING A REDUCED DISPERSITY TABULAR GRAIN EMULSION

[75] Inventors: Allen K. Tsaur; Mamie Kam-Ng, both of Fairport, N.Y.

[73] Assignee: Eastman Kodak Company, Rochester, N.Y.

[21] Appl. No.: 700,020

[22] Filed: May 14, 1991

[51] Int. Cl.[5] ..... G03C 1/015

[52] U.S. Cl. ..... 430/569; 430/567; 430/637

[58] Field of Search ..... 430/567, 569, 637

[56] References Cited

U.S. PATENT DOCUMENTS

| | | | |
|---|---|---|---|
| 4,434,226 | 2/1984 | Wilgus et al. | 430/567 |
| 4,452,882 | 6/1984 | Akimura et al. | 430/569 |
| 4,477,565 | 10/1984 | Himmelwright | 430/567 |
| 4,722,886 | 2/1988 | Nottorf | 430/569 |
| 4,797,354 | 1/1989 | Saitou et al. | 430/567 |

FOREIGN PATENT DOCUMENTS

| | | | |
|---|---|---|---|
| 808228 | 1/1959 | United Kingdom | 430/569 |

OTHER PUBLICATIONS

*Research Disclosure*, vol. 232, Aug. 1983, Item 23212, (Mignot French Pat. 2,534,036 corresponding).

*Primary Examiner*—Charles L. Bowers, Jr.
*Assistant Examiner*—Janet C. Baxter
*Attorney, Agent, or Firm*—Carl O. Thomas

[57] ABSTRACT

A process is disclosed of preparing a photographic emulsion containing tabular silver halide grains exhibiting a reduced degree of total grain dispersity. After forming a population of silver halide grain nuclei containing parallel twin planes, a portion of the silver halide grain nuclei are ripened out. The silver halide grain nuclei containing parallel twin planes remaining are then grown to form tabular silver halide grains. The total grain dispersity of the emulsion is reduced by incorporating bromide ion in the dispersing medium prior to forming the silver halide grain nuclei and, at the time parallel twin planes are formed in the silver halide grain nuclei, a polyalkylene oxide block copolymer surfactant containing at least three terminal lipophilic alkylene oxide block units each linked through a hydrophilic alkylene oxide block linking unit accounting for at least 4 percent of the molecular weight of the copolymer.

20 Claims, 3 Drawing Sheets

CONTROL

10 μm

10 μm

PROCESS OF PREPARING A REDUCED DISPERSITY TABULAR GRAIN EMULSION

FIELD OF THE INVENTION

The invention relates to a process of preparing photographic emulsions. More specifically, the invention relates to an improved process for the preparation of a tabular grain photographic emulsion.

BACKGROUND

Although tabular grains had been observed in silver bromide and bromoiodide photographic emulsions dating from the earliest observations of magnified grains and grain replicas, it was not until the early 1980's that photographic advantages, such as improved speed-granularity relationships, increased covering power both on an absolute basis and as a function of binder hardening, more rapid developability, increased thermal stability, increased separation of blue and minus blue imaging speeds, and improved image sharpness in both mono- and multi-emulsion layer formats, were realized to be attainable from silver bromide and bromoiodide emulsions in which the majority of the total grain population based on grain projected area is accounted for by tabular grains satisfying the mean tabularity relationship:

$$D/t^2 > 25$$

where

D is the equivalent circular diameter (ECD) in μm of the tabular grains and t is the thickness in μm of the tabular grains. Once photographic advantages were demonstrated with tabular grain silver bromide and bromoiodide emulsions techniques were devised to prepare tabular grains containing silver chloride alone or in combination with other silver halides. Subsequent investigators have extended the definition of tabular grain emulsions to those in which the mean aspect ratio (D:t) of grains having parallel crystal faces is as low as 2:1.

Notwithstanding the many established advantages of tabular grain silver bromide and bromoiodide emulsions, the art has observed that these emulsions tend toward more disperse grain populations than can be achieved in the preparation of regular, untwinned grain populations—e.g., cubes, octahedra and cubo-octahedral grains. This has been a concern, since reducing grain dispersity is a fundamental approach to reducing the imaging variance of the grains, and this in practical terms can be translated into more nearly uniform grain responses and higher mean grain efficiencies in imaging.

Figure 1:
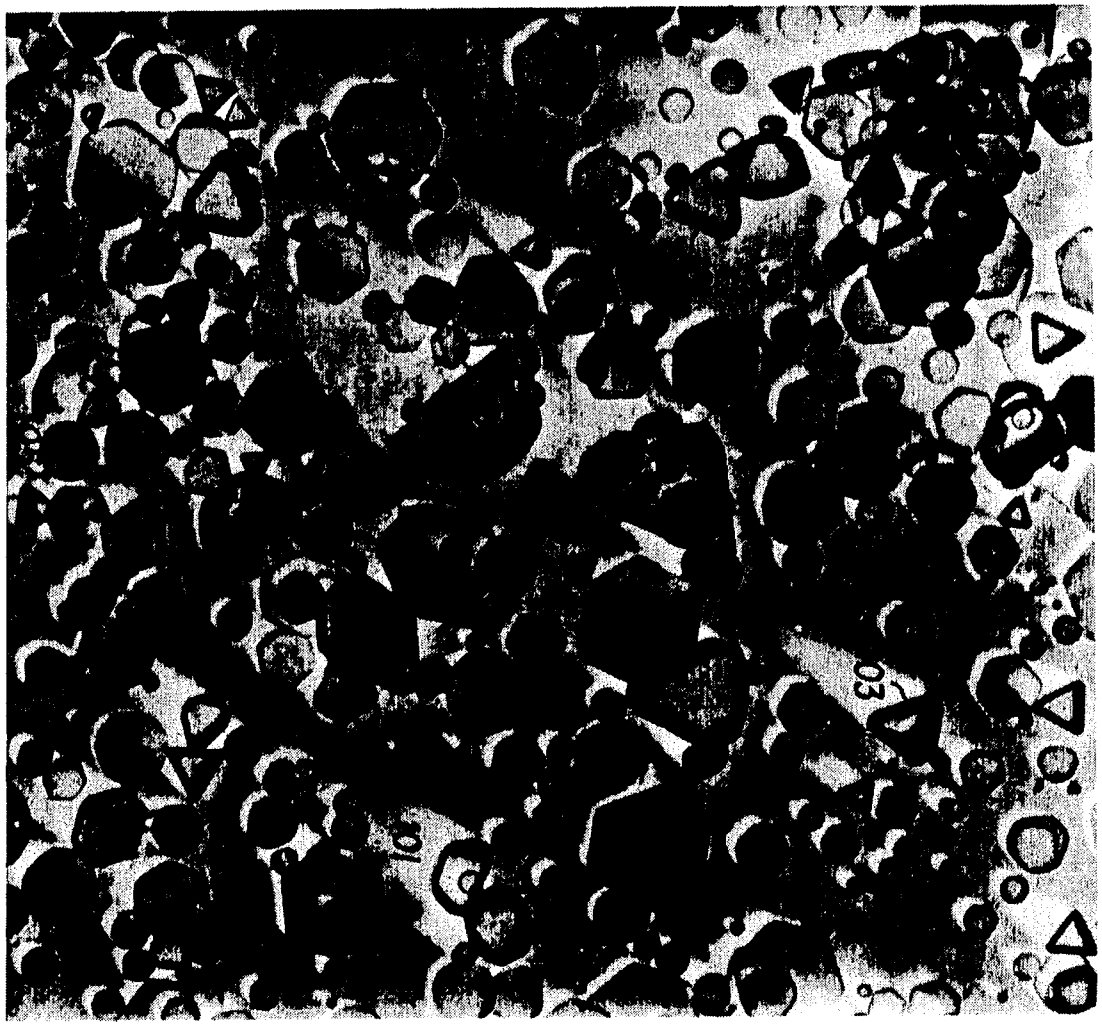
FIG. 1 (PRIOR ART)
FIG. 1 is a photomicrograph of a conventional tabular grain emulsion.

In the earliest tabular grain emulsions dispersity concerns were largely focused on the presence of significant populations of nonconforming grain shapes among the tabular grains conforming to an aim grain structure. FIG. 1 is a photomicrograph of an early high aspect ratio tabular grain silver bromoiodide emulsion first presented by Wilgus et al U.S. Pat. No. 4,434,226 to demonstrate the variety of grains that can be present in a high aspect ratio tabular grain emulsion While it is apparent that the majority of the total grain projected area is accounted for by tabular grains, such as grain 101, nonconforming grains are also present. The grain 103 illustrates a nontabular grain. The grain 105 illustrates a fine grain. The grain 107 illustrates a nominally tabular grain of nonconforming thickness. Rods, not shown in FIG. 1, also constitute a common nonconforming grain population in tabular grain silver bromide and bromoiodide emulsions.

While the presence of nonconforming grain shapes in tabular grain emulsions has continued to detract from achieving narrow grain dispersities, as procedures for preparing tabular grains have been improved to reduce the inadvertent inclusion of nonconforming grain shapes, interest has increased in reducing the dispersity of the tabular grains. Only a casual inspection of FIG. 1 is required to realize that the tabular grains sought themselves exhibit a wide range of equivalent circular diameters.

A technique for quantifying grain dispersity that has been applied to both nontabular and tabular grain emulsions is to obtain a statistically significant sampling of the individual grain projected areas, calculate the corresponding ECD of each grain, determine the standard deviation of the grain ECDs, divide the standard deviation of the grain population by the mean ECD of the grains sampled and multiply by 100 to obtain the coefficient of variation (COV) of the grain population as a percentage. While highly monodisperse (COV<20 percent) emulsions containing regular nontabular grains can be obtained, even the most carefully controlled precipitations of tabular grain emulsions have rarely achieved a COV of less than 20 percent. *Research Disclosure*, Vol. 232, Aug. 1983, Item 23212 (Mignot French Patent 2,534,036, corresponding) discloses the preparation of silver bromide tabular grain emulsions with COVs ranging down to 15. *Research Disclosure* is published by Kenneth Mason Publications, Ltd., Dudley Annex, 21a North Street, Emsworth, Hampshire P010 7DQ, England.

Saitou et al U.S. Pat. No. 4,797,354 reports in Example 9 a COV of 11.1 percent; however, this number is not comparable to that reported by Mignot. Saitou et al is reporting only the COV within a selected tabular grain population. Excluded from these COV calculations is the nonconforming grain population within the emulsion, which, of course, is the grain population that has the maximum impact on increasing grain dispersity and overall COV. When the total grain populations of the Saitou et al emulsions are sampled, significantly increased COVs result.

Techniques for quantitatively evaluating emulsion grain dispersity originally developed for nontabular grain emulsions and later applied to tabular grain emulsions provide a measure of the dispersity of ECDs. Given the essentially isometric shapes of most nontabular grains, dispersity measurements based on ECDs were determinative. As first the nonconforming grain populations and then the diameter dispersity of the tabular grains themselves have been restricted in tabular grain emulsions, those skilled in the art have begun to address now a third variance parameter of tabular grain emulsions which, unlike the first two, is not addressed by COV measurements. As preparations of tabular grain emulsions have become better controlled thickness variances with tabular grain populations have been reduced somewhat, although the art does not appear to have explicitly addressed the tabular grain thickness dispersity.

While varied claims for reduced dispersity of tabular grain emulsions have been advanced, many involving narrowly limited (e.g., Saitou et al, cited above) or highly specialized (e.g., Mignot, cited above) precipitation techniques, one approach to dispersity reduction compatible with generally useful precipitation procedures is the post nucleation solvent ripening technique. Himmelwright U.S. Pat. No. 4,477,565 and Nottorf U.S. Patent 4,722,886 are illustrative of this approach. At a point in the precipitation process in which the grains contain the parallel twin planes necessary for tabularity a silver halide solvent is introduced to ripen out a portion of the grains. This narrows the dispersity of the grain population and reduces the dispersity of the final tabular grain emulsion produced.

CROSS-REFERENCED FILINGS

The following concurrently filed, commonly assigned patent applications are cross-referenced:

Tsaur and Kam-Ng U.S. Ser. No. 700,220, titled PROCESS OF PREPARING A REDUCED DISPERSITY TABULAR GRAIN EMULSION, discloses a process for the preparation of tabular grain emulsions of reduced dispersity that employs an alkylene oxide block copolymer surfactant that contains two terminal lipophilic block units joined by a central hydrophilic block unit.

Tsaur and Kam-Ng U.S. Ser. No. 700,019, titled PROCESS OF PREPARING A REDUCED DISPERSITY TABULAR GRAIN EMULSION, discloses a process for the preparation of tabular grain emulsions of reduced dispersity that employs an alkylene oxide block copolymer surfactant that contains two terminal hydrophilic block units joined by a central lipophilic block unit.

Tsaur and Kam-Ng U.S. Ser. No. 699,851, titled PROCESS OF PREPARING A REDUCED DISPERSITY TABULAR GRAIN EMULSION, discloses a process for the preparation of tabular grain emulsions of reduced dispersity that employs an alkylene oxide block copolymer surfactant that contains at least three terminal hydrophilic block units joined by a central lipophilic block linking unit.

Tsaur and Kam-Ng U.S. Ser. No. 699,855, titled A VERY LOW COEFFICIENT OF VARIATION TABULAR GRAIN EMULSION discloses a coprecipitated grain population having a coefficient of variation of less than 10 percent and consisting essentially of tabular grains.

Loblaw, Tsaur and Kam-Ng U.S. Ser. No. 700,228, refiled as continuation-in-part application Ser. No. 849,928 on Mar. 12, 1992 titled IMPROVED PHOTOTYPESETTING PAPER discloses a phototypesetting paper containing a tabular grain emulsion having a coefficient of variation of less than 15 percent.

Dickerson and Tsaur U.S. Ser. No. 699,840, refiled as continuation-in-part application Ser. No. 849,917 on Mar. 12, 1992 titled RADIOGRAPHIC ELEMENTS WITH IMPROVED DETECTIVE QUANTUM EFFICIENCIES discloses a dual coated radiographic element containing a tabular grain emulsion having a coefficient of variation of less than 15 percent.

Jagannathan, Mehta and Tsaur U.S. Ser. No. 700,227, refiled as continuation-in-part application Ser. No. 848,626 on Mar. 9, 1992 titled HIGH EDGE CUBICITY TABULAR GRAIN EMULSIONS discloses tabular grain emulsions in which an increased percentage of the edge surfaces of the tabular grains lie in non-{111} crystallographic planes.

SUMMARY OF THE INVENTION

In attempting to achieve a minimal level of grain dispersity in a tabular grain emulsion there is a hierarchy of objectives The first objective is to eliminate or reduce to negligible levels nonconforming grain populations from the tabular grain emulsion during grain precipitation process. The presence of one or more nonconforming grain populations (usually nontabular grains) within an emulsion containing predominantly tabular grains is a primary concern in seeking emulsions of minimal grain dispersity. Nonconforming grain populations in tabular grain emulsions typically exhibit lower projected areas and greater thicknesses than the tabular grains. Nontabular grains interact differently with light on exposure than tabular grains. Whereas the majority of tabular grain surface areas are oriented parallel to the coating plane, nontabular grains exhibit near random crystal facet orientations. The ratio of surface area to grain volume is much higher for tabular grains than for nontabular grains. Finally, lacking parallel twin planes, nontabular grains differ internally from the conforming tabular grains. All of these differences of nontabular grains apply also to nonconforming thick (singly twinned) tabular grains as well.

The second objective is to minimize the ECD variance among conforming tabular grains. Once the nonconforming grain population of a tabular grain emulsion has been well controlled, the next level of concern is the diameter variances among the tabular grains. The probability of photon capture by a particular grain on exposure of an emulsion is a function of its ECD. Spectrally sensitized tabular grains with the same ECDs have the same photon capture capability.

The third objective is to minimize variances in the thicknesses of the tabular grains within the conforming tabular grain population. Achievement of the first two objectives in dispersity control can be measured in terms of COV, which provides a workable criterion for distinguishing emulsions on the basis of grain dispersity. As between tabular grain emulsions of similar COVs further ranking of dispersity can be based on assessments of grain thickness dispersity. At present, this cannot be achieved with the same quantitative precision as in calculating COVs, but it is nevertheless an important basis for distinguishing tabular grain populations. A tabular grain with an ECD of 1.0 μm and a thickness of 0.01 μm contains only half the silver of a tabular grain with the same ECD and a thickness of 0.02 μm. The photon capture capability in the spectral region of native sensitivity of the second grain is twice that of the first, since photon capture within the grain is a function of grain volume. Further, the light reflectances of the two grains are quite dissimilar.

The present invention is directed to a tabular grain emulsion precipitation process which achieves reductions in grain dispersity and is capable of satisfying each of the foregoing three objectives. It is an improvement on the technique for preparing silver tabular grain emulsions of reduced dispersity that relies on grain nucleation followed by ripening and post-ripening grain growth. The invention is capable of reducing and in preferred forms eliminating the inclusion of nontabular grains and thick (singly twinned) tabular grains in a tabular grain population conforming to aim dimensions. The invention is capable of reducing ECD variances among the grains of an emulsion—specifically among the tabular grains containing parallel twin planes. In specifically preferred forms the invention is capable of producing tabular grain emulsions exhibiting coefficients of variation of less than 20 percent and, in optimum forms, coefficients of variation of less than 10. The processes of the invention also have the capability of minimizing variations in the thicknesses of the tabular grain population.

In one aspect, this invention is directed to a process of preparing a photographic emulsion containing tabular silver halide grains exhibiting a reduced degree of total grain dispersity comprising (i) forming in the presence of a dispersing medium a population of silver halide grain nuclei containing parallel twin planes, (ii) ripening out a portion of the silver halide grain nuclei, and (iii) growing the silver halide grain nuclei containing parallel twin planes remaining to form tabular silver halide grains.

The process is characterized in that (a) prior to forming the silver halide grain nuclei halide ion consisting essentially of bromide ion is present in the dispersing medium and, (b) at the time parallel twin planes formed in the silver halide grain nuclei, a grain dispersity reducing concentration of a polyalkylene oxide block copolymer surfactant is present comprised of at least three terminal lipophilic alkylene oxide block units each linked through a hydrophilic alkylene oxide block linking unit accounting for from 4 to 96 percent of the molecular weight of the copolymer.

DESCRIPTION OF PREFERRED EMBODIMENTS

The present invention is an improvement on a post nucleation solvent ripening process for preparing tabular grain emulsions. The process of the invention reduces both the overall dispersity of the grain population and the dispersity of the tabular grain population. In a post nucleation solvent ripening process for preparing tabular grain emulsions the first step is to form a population of silver halide grain nuclei containing parallel twin planes. A silver halide solvent is next used to ripen out a portion of the silver halide grain nuclei, and the silver halide grain nuclei containing parallel twin planes not ripened out are then grown to form tabular silver halide grains.

To achieve the lowest possible grain dispersities the first step is undertake formation of the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which an aqueous silver salt solution and an aqueous bromide salt are concurrently introduced into a dispersing medium containing water and a hydrophilic colloid peptizer. Prior to introducing the silver salt a small amount of bromide salt is added to the reaction vessel to establish a slight stoichiometric excess of halide ion. One or both of chloride and iodide salts can be introduced through the bromide jet or as a separate aqueous solution through a separate jet. It is preferred to limit the concentration of chloride and/or iodide to about 20 mole percent, based on silver, most preferably these other halides are present in concentrations of less than 10 mole percent (optimally less than 6 mole percent) based on silver. Silver nitrate is the most commonly utilized silver salt while the halide salts most commonly employed are ammonium halides and alkali metal (e.g., lithium, sodium or potassium) halides. The ammonium counter ion does not function as a ripening agent since the dispersing medium is at an acid pH—i.e., less than 7.0.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 μm, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

The present invention achieves reduced grain dispersity by producing prior to ripening a population of parallel twin plane containing grain nuclei in the presence of a selected surfactant. Specifically, it has been discovered that the dispersity of the tabular grain emulsion can be reduced by introducing parallel twin planes in the grain nuclei in the presence of a polyalkylene oxide block copolymer surfactant comprised of at least three terminal lipophilic alkylene oxide block units each linked through a hydrophilic alkylene oxide block linking unit accounting for at least 4 percent of the molecular weight of the copolymer.

Polyalkylene oxide block copolymer surfactants generally and those contemplated for use in the practice of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36, the disclosures of which are here incorporated by reference.

The polyalkylene oxide block copolymer surfactants employed in the practice of this invention contain at least three terminal lipophilic alkylene oxide block units linked through a hydrophilic alkylene oxide block linking unit and can be, in a simple form, schematically represented as indicated by formula I below:

$$(H—LAO)_z—HOL—(LAO—H)_z \quad (I)$$

where

LAO in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed in the practice of the invention can take the form shown in formula II:

$$(H—LAO—HAO)_z—L—(HAO—LAO—H)_z \quad \text{(II)}$$

where

HAO in each occurrence represents a hydrophilic alkylene oxide block unit,

LAO in each occurrence represents a terminal lipophilic alkylene oxide block unit, L represents a linking group, such as amine or diamine, z is 2 and z' is 1 or 2.

The linking group L can take any convenient form. It is generally preferred to choose a linking group that is itself hydrophilic When z+z' equal three, the linking group must be trivalent. Amines can be used as trivalent linking groups. When an amine is used to form the linking unit L, the polyalkylene oxide block copolymer surfactants employed in the practice of the invention can take the form shown in formula III:

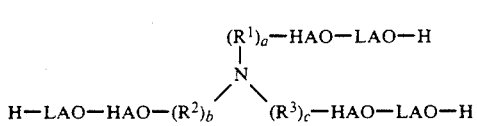

(III)

where

HAO and LAO are as previously defined; $R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula III.

When z+z' equal four, the linking group must be tetravalent. Diamines are preferred tetravalent linking groups. When a diamine is used to form the linking unit L, the polyalkylene oxide block copolymer surfactants employed in the practice of the invention can take the form shown in formula IV:

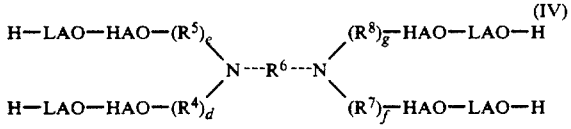

(IV)

where $R^4$, $R^5$, $R^6$, $R^7$ and $R^8$ are independently selected hydrocarbon linking groups, preferably phenylene groups or alkylene groups containing from to 10 carbon atoms; and d, e, f and g are independently zero or 1.

Generally each of LAO and HAO contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants. It is generally preferred that HAO be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants employ ethylene oxide repeating units to form the hydrophilic (HAO) block units and 1,2-propylene oxide repeating units to form the lipophilic (LAO) block units. At least three propylene oxide repeating units are required to produce a lipophilic block repeating unit. When so formed, each H—LAO—HAO— group satisfies formula V:

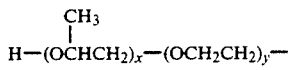

(V)

where

Y is at least 1 (preferably at least 2) and can range up to 340 or more and x is chosen so that the 1,2-propylene oxide block unit maintains the necessary balance of lipophilic and hydrophilic qualities necessary to retain surfactant activity. This allows x to be chosen so that the hydrophilic block units together constitute from 4 to 96 percent (optimally 10 to 80 percent) by weight of the total block copolymer. In this instance the hydrophilic alkylene oxide block linking unit, which includes the ethylene oxide repeating units and the linking moieties, constitutes from 4 to 96 percent (optimally 20 to 90 percent) of the total weight of the block copolymer. Within the above ranges, x can range from 3 to 250 or more.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted, provided the intended lipophilic and hydrophilic properties are retained. For example, the propylene oxide repeating unit is only one of a family of repeating units that can be illustrated by formula VI:

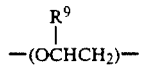

(VI)

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula VII:

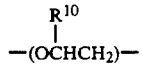

(VII)

where $R^{10}$ is hydrogen or a hydrophilic group, such as a hydrocarbon group of the type forming $R^9$ above additionally having one or more polar substituents—e.g., one, two, three or more hydroxy and/or carboxy groups.

The overall molecular weight of the polyalkylene oxide block copolymer surfactants satisfying the requirements of this invention have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 50,000, preferably less than about 30,000, are contemplated for use.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 50 percent of the interim weight of silver. However, surfactant concentrations of 100 percent of the interim weight of silver or more are considered feasible.

The invention is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium.

The pAg of the dispersing medium is preferably maintained in the range of from 5.4 to 10.3 and, for achieving a COV of less than 10 percent, optimally in the range of from 7.0 to 10.0. At a pAg of greater than 10.3 a tendency toward increased tabular grain ECD and thickness dispersities is observed. Any convenient conventional technique for monitoring and regulating pAg can be employed.

Reductions in grain dispersities have also been observed as a function of the pH of the dispersing medium. Both the incidence of nontabular grains and the thickness dispersities of the nontabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

The formation of grain nuclei containing parallel twin planes is undertaken at conventional precipitation temperatures for photographic emulsions, with temperatures in the range of from 20° to 80° C. being particularly preferred and temperature of from 20° to 60° C. being optimum.

Once a population of grain nuclei containing parallel twin planes has been established as described above, the next step is to reduce the dispersity of the grain nuclei population by ripening. The objective of ripening grain nuclei containing parallel twin planes to reduce dispersity is disclosed by both Himmelwright U.S. Pat. No. 477,565 and Nottorf U.S. Pat. No. 4,722,886, the disclosures of which are here incorporated by reference. Ammonia and thioethers in concentrations of from about 0.01 to 0.1N constitute preferred ripening agent selections.

Instead of introducing a silver halide solvent to induce ripening it is possible to accomplish the ripening step by adjusting pH to a high level—e.g., greater than 9.0. A ripening process of this type is disclosed by Buntaine and Brady U.S. Ser. No. 452,487, filed Dec. 19, 1989, titled FORMATION OF TABULAR GRAIN SILVER HALIDE EMULSIONS UTILIZING HIGH pH DIGESTION, commonly assigned, now U.S. Pat. No. 5,013,641. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 6.0) by introducing a conventional acidifying agent, such as a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition. Although the formation of grain nuclei incorporates bromide ion and only minor amounts of chloride and/or iodide ion, the low dispersity tabular grain emulsions produced at the completion of the growth step can contain in addition to bromide ions any one or combination of iodide and chloride ions in any proportions found in tabular grain emulsions. If desired, the growth of the tabular grain emulsion can be completed in such a manner as to form a core-shell emulsion of reduced dispersity. The shelling procedure taught by Evans et al U.S. Pat. No. 4,504,570, issued Mar. 12, 1985, is here incorporated by reference. Internal doping of the tabular grains, such as with group VIII metal ions or coordination complexes, conventionally undertaken to obtain improved reversal and other photographic properties are specifically contemplated. For optimum levels of dispersity it is, however, preferred to defer doping until after the grain nuclei containing parallel twin planes have been obtained.

In optimizing the process of this invention for minimum tabular grain dispersity levels (COV less than 10 percent) it has been observed that optimizations differ as a function of iodide incorporation in the grains as well as the choices of peptizers.

While any conventional hydrophilic colloid peptizer can be employed in the practice of this invention, it is preferred to employ gelatinopeptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.5 to achieve a minimum (less than 10 percent) COV. When a regular gelatino-peptizer is employed, the pH during twin plane formation is maintained at less than 3.0 to achieve a minimum COV.

When regular gelatin is employed prior to post-ripening grain growth, the surfactant is selected so that the hydrophilic block linking unit (e.g., HOL) accounts for 4 to 96 (preferably 5 to 85 and optimally 10 to 80) percent of the total surfactant molecular weight. It is preferred that x be at least 3 and that the minimum molecular weight of the surfactant be at least 1100 and optimally at least 2000. The concentration levels of surfactant are preferably restricted as iodide levels are increased.

When oxidized gelatino-peptizer is employed prior to post-ripening grain growth, no iodide is added during post-ripening grain growth and the hydrophilic block linking unit (e.g., HOL) accounts for 4 to 35 (optimally 10 to 30) percent of the total surfactant molecular weight. The minimum molecular weight of the surfactant continues to be determined by the minimum values of x—i.e., x=3. In optimized forms the minimum molecular weight of the surfactant is 1100, preferably 2000.

Apart from the features that have been specifically discussed the tabular grain emulsion preparation procedures, the tabular grains that they produce, and their further use in photography can take any convenient conventional form. Such conventional features are illustrated by the following incorporated by reference disclosures:

| | |
|---|---|
| ICBR-1 | Research Disclosure, Vol. 38, December 1989, Item 308,119; |
| ICBR-2 | Research Disclosure, Vol. 225, January 1983, Item 22,534; |
| ICBR-3 | Wey et al U.S. Pat. No. 4,414,306, issued Nov. 8, 1983; |
| ICBR-4 | Solberg et al U.S. Pat. No. 4,433,048, issued Feb. 21, 1984; |
| ICBR-5 | Wilgus et al U.S. Pat. No. 4,434,226, issued Feb. 28, 1984; |
| ICBR-6 | Maskasky U.S. Pat. No. 4,435,501, issued Mar. 6, 1984; |
| ICBR-7 | Kofron et al U.S. Pat. No. 4,439,520, issued Mar. 27, 1987; |
| ICBR-8 | Maskasky U.S. Pat. No. 4,643,966, issued Feb. 17, 1987; |
| ICBR-9 | Daubendiek et al U.S. Pat. No. 4,672,027, issued Jan. 9, 1987; |
| ICBR-10 | Daubendiek et al U.S. Pat. No. 4,693,964, issued Sept. 15, 1987; |
| ICBR-11 | Maskasky U.S. Pat. No. 4,713,320, issued Dec. 15, 1987; |
| ICBR-12 | Saitou et al U.S. Pat. No. 4,797,354, issued Jan. 10, 1989; |
| ICBR-13 | Ikeda et al U.S. Pat. No. 4,806,461, issued Feb. 21, 1989; |
| ICBR-14 | Makino et al U.S. Pat. No. 4,853,322, issued Aug. 1, 1989; and |
| ICBR-15 | Daubendiek et al U.S. Pat. No. 4,914,014, issued Apr. 3, 1990. |

EXAMPLES

The invention can be better appreciated by reference to the following specific examples.

EXAMPLES 1 and 2

The purpose of these examples is to demonstrate the effectiveness of the surfactant in achieving a low level of dispersity in a silver bromoiodide emulsion in which iodide is run into the reaction vessel during the growth step.

EXAMPLE 1

(a control) (MK-103)

No surfactant was employed.

In a 4-liter reaction vessel was placed an aqueous gelatin solution (composed of 1 liter of water, 1.3 g of alkali-processed gelatin, 4.2 ml of 4N nitric acid solution, 2.5 g of sodium bromide and having a pAg of 9.72) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 172.2 ml of an aqueous gelatin solution (containing 41.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 14.2 g of sodium bromide and 0.71 g of potassium iodide) were added at a constant rate for a period of 40 minutes. Then, 299 ml of an aqueous silver nitrate solution (containing 81.3 g of silver nitrate) and 298 ml of an aqueous halide solution (containing 50 g of sodium bromide and 2.5 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.3 g of sodium bromide and 1.07 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous halide solution (containing 37.1 g of sodium bromide and 1.85 g of potassium iodide) were simultaneously added to the aforesaid mixture at constant rate over a period of 16.6 minutes. The silver halide emulsion thus obtained contained 3 mole% of iodide.

The properties of grains of this emulsion were found to be as follows:

Average Grain ECD: 1.81 μm.
Average Grain Thickness: 0.122 μm.
Tabular Grain Projected Area: approx. 100%.
Average Aspect Ratio of the Grains: 14.8.
Average Tabularity of the Grains: 121.
Coefficient of Variation of Total Grains: 29.5%.

EXAMPLE 2

(MK-179)

Example 1 was repeated, except that

TETRONIC TM-150R8,
N,N,N',N'-tetrakis{$H[OCH(CH_3)CH_2]_x(OCH_2CH_2)_y$—}
ethylenediamine surfactant, x=18, y=92, was additionally present in the reaction vessel prior to the introduction of silver salt. The surfactant constituted 2.32 percent by weight of the total silver introduced prior to the post-ripening grain growth step.

The properties of grains of this emulsion were found to be as follows:

Average Grain ECD: 1.11 μm.
Average Grain Thickness: 0.255 μm.
Tabular Grain Projected Area: approx. 100%.
Average Aspect Ratio of the Grains: 4.4.
Average Tabularity of the Grains: 17.
Coefficient of Variation of Total Grains: 9.6%

VISUAL COMPARISON OF GRAIN DISPERSITIES

Figure 2:
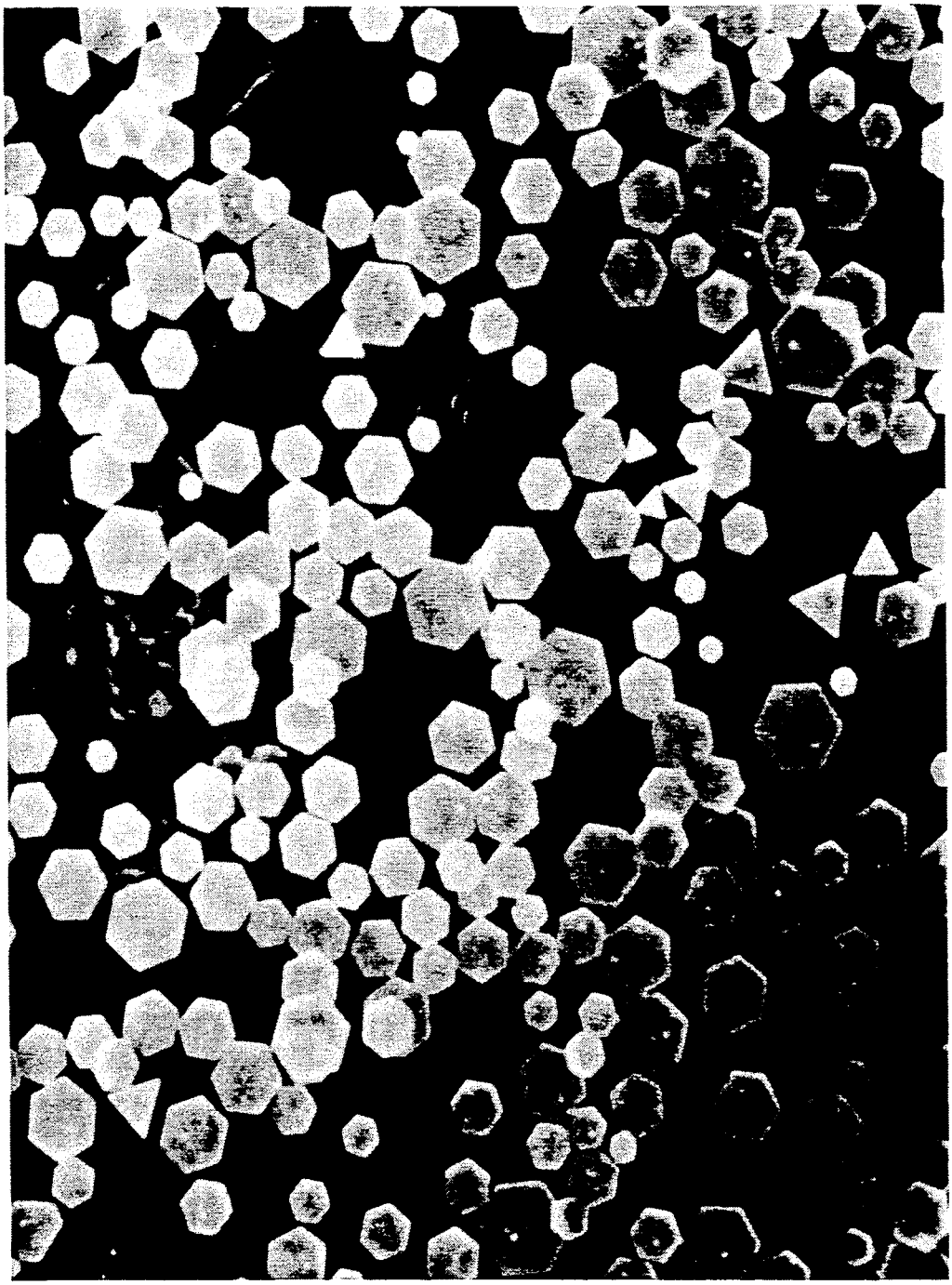
FIGS. 2 and 3 are scanning electron micrographs of a control emulsion and an emulsion prepared according to the invention, respectively.
Figure 3:
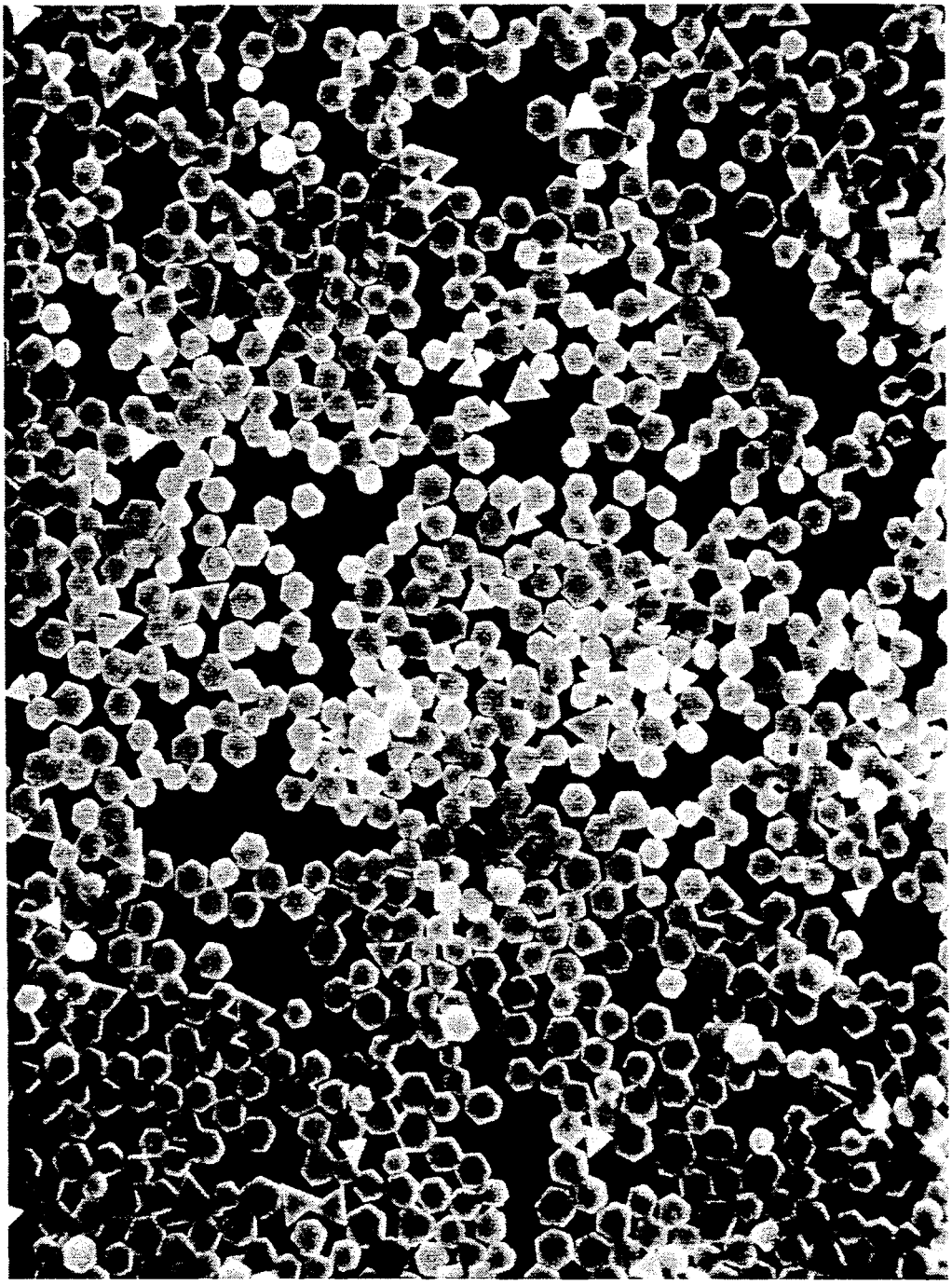

FIGS. 2 and 3 are scanning electron micrographs of the emulsions of Examples 1 and 2, respectively. By visually comparing the micrographs the reduced grain-to-grain variances of the emulsion of Example 2 is immediately apparent.

EXAMPLES 3 AND 4

The purpose of these examples is to demonstrate the effectiveness of the surfactant in achieving reduction of dispersity in a silver bromide emulsion.

EXAMPLE 3

(a control) (AKT-415)

This example illustrates an emulsion preparation procedure failing to satisfy the requirements of the invention solely in that no surfactant was included in the reaction vessel.

In a 4-liter reaction vessel was placed an aqueous gelatin solution (composed of 1 liter of water, 1.25 g of oxidized alkali-processed gelatin, 3.7 ml of 4N nitric acid solution, 1.12 g of sodium bromide and having pAg of 9.39) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Thereafter, into the mixture was added 14.2 mol of an aqueous sodium bromide solution (containing 1.46 g of sodium bromide) after 1 minute of mixing. The temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of oxidized alkali-processed gelatin and 5.5 ml of 4N nitric acid solution) was added to the mixture over a period of 2 minutes. After then, 83.3 ml of an aqueous silver nitrate solution (containing 22.6 g of silver nitrate) and 81.3 ml of an aqueous sodium bromide solution (containing 14.6 g of sodium bromide) were added at a constant rate for a period of 40 minutes. Then, 299 ml of an aqueous silver nitrate solution containing 81.3 g of silver nitrate) and 285.8 ml of an aqueous sodium bromide solution (containing 51.5 g of sodium bromide) were simultaneously added to the aforesaid mixture at constant ramp with both starting from 2.08 ml/min for the subsequent 35 minutes. Then, 349 ml of an aqueous silver nitrate solution (containing 94.9 g of silver nitrate) and 331.6 ml of an aqueous sodium bromide solution (containing 59.7 g of sodium bromide) were simultaneously added to the aforesaid mixture at constant rate over a period of 23.3 minutes. The silver halide emulsion thus obtained was washed.

The properties of grains of this emulsion were found to be as follows:

Average Grain ECD: 2.30 μm.
Average Grain Thickness: 0.075 μm.
Tabular Grain Projected Area: approx. 100%.
Average Aspect Ratio of the Grains: 30.7.
Average Tabularity of the Grains: 409.
Coefficient of Variation of Total Grains: 36.0%.

EXAMPLE 4

(AKT-639)

Example 3 was repeated, except that

TETRONIC TM -50R1,
N,N,N',N'-tetrakis{$H[OCH(CH_3)CH_2]_x(OCH_2CH_2)_y$—}
ethylenediamine surfactant, x=10, y=1, was additionally present in the reaction vessel prior to the introduction of silver salt. The surfactant constituted of 4.63 percent by weight of the total silver introduced prior to the post-ripening grain growth step.

The properties of grains of this emulsion were found to be as follows:

Average Grain ECD: 1.28 μm.
Average Grain Thickness: 0.091 μm.
Tabular Grain Projected Area: approx. 100%.
Average Aspect Ratio of the Grains: 14.1.
Average Tabularity of the Grains: 154.5.
Coefficient of Variation of Total Grains: 19.8%

EXAMPLES 5 AND 5

The purpose of Examples 5 and 6 is to demonstrate the effectiveness of a surfactant, the lipophilic block units of which constitute an intermediate percentage thereof, in achieving a low level of dispersity in a silver iodobromide emulsion.

EXAMPLE 5

(a control) (MK-188)

No surfactant was employed.

In a 4-liter reaction vessel was placed an aqueous gelatin solution (composed of 1 liter of water, 1.3 g of alkali-processed gelatin, 4.2 ml of 4N nitric acid solution, 2.5 g of sodium bromide and having a pAg of 9.72) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 172.2 ml of an aqueous gelatin solution (containing 41.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 14.5 g of sodium bromide and 0.24 g of potassium iodide) were added at a constant rate for a period of 40 minutes. Then, 299 ml of an aqueous silver nitrate solution (containing 81.3 g of silver nitrate) and 298 ml of an aqueous halide solution (containing 51 g of sodium bromide and 0.83 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.7 g of sodium bromide and 0.36 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous halide solution (containing 37.9 g of sodium bromide and 0.62 g of potassium iodide) were simultaneously added to the aforesaid mixture at constant rate over a period of 16.6 minutes. The silver halide emulsion thus obtained contained 1 mole% of iodide.

The properties of grains of this emulsion were found to be as follows:

Average Grain ECD: 1.90 μm.
Average Grain Thickness: 0.111 μm.
Tabular Grain Projected Area: approx. 100%.
Average Aspect Ratio of the Grains: 17.1.
Average Tabularity of the Grains: 154.
Coefficient of Variation of Total Grains: 25.8%.

EXAMPLE 6

(MK-187)

Example 5 was repeated, except that

TETRONIC TM -90R4,
N,N,N',N'-tetrakis{$H[OCH(CH_3)CH_2]_x(OCH_2CH_2)_y$—}
ethylenediamine surfactant, x=19, y=16, was additionally present in the reaction vessel prior to the introduction of silver salt. The surfactant constituted 2.32 percent by weight of the total silver introduced prior to the post-ripening grain growth step.

The properties of grains of this emulsion were found to be as follows:

Average Grain ECD: 1.09 μm.
Average Grain Thickness: 0.270 μm.
Tabular Grain Projected Area: approx. 100%.
Average Aspect Ratio of the Grains: 4.0.
Average Tabularity of the Grains: 15.
Coefficient of Variation of Total Grains: 12.4%.

EXAMPLES 7-9

These examples have been included to demonstrate the effectiveness of the surfactants of the invention at differing concentration levels. The emulsions were prepared according to Example 5, with the sole difference being the incorporation of the surfactant used in Example 2 at the concentration level indicated in Table I.

The results are summarized in Table I, where:

ECD=Mean equivalent circular diameter of the grains in micrometers;
t=Mean thickness of the grains in micrometers;
AR=Mean aspect ratio; and SUR = Surfactant concentration in weight percent, based on total silver prior to the post-ripening grain growth step.

TABLE I

| Example | ECD | t | AR | COV | SUR |
|---|---|---|---|---|---|
| 5 (MK-188) | 1.90 | 0.111 | 17.1 | 25.8 | 0 |
| 7 (MK-195) | 1.46 | 0.134 | 10.9 | 16.2 | 2.32 |
| 8 (MK-194) | 1.24 | 0.181 | 6.9 | 14.6 | 11.58 |
| 9 (MK-192) | 1.31 | 0.201 | 6.5 | 13.1 | 23.16 |

The invention has been described in detail with particular reference to preferred embodiments thereof, but it will be understood that variations and modifications can be effected within the spirit and scope of the invention.

What is claimed is:

1. A process of preparing a photographic emulsion containing tabular silver halide grains exhibiting a reduced degree of total grain dispersity comprising forming in the presence of a dispersing medium a population of silver halide grain nuclei containing parallel twin planes, ripening out a portion of the silver halide grain nuclei, and growing the silver halide grain nuclei containing parallel twin planes remaining to form tabular silver halide grains, characterized in that (a) prior to forming the silver halide grain nuclei halide ion consisting essentially of bromide ion is present in the dispersing medium and, (b) at the time parallel twin planes formed in the silver halide grain nuclei, a grain dispersity reducing concentration of a polyalkylene oxide block copolymer surfactant is present comprised of at least three terminal lipophilic alkylene oxide block units each linked through a hydrophilic alkylene oxide block linking unit accounting for from 4 to 96 percent of the molecular weight of the copolymer.

2. A process according to claim 1 further characterized in that the molecular weight of the polyalkylene oxide block copolymer surfactant is greater than 1,100 and less than 50,000.

3. A process according to claim 1 further characterized in that the polyalkylene oxide block copolymer surfactant present during twin plane formation constitutes at least 0.1 percent by weight of the silver present.

4. A process according to claim 1 further characterized in that the pAg of the dispersing medium during grain nucleation is in the range of from 5.4 to 10.3.

5. A process according to claim 1 further characterized that the pH of the dispersing medium during twin plane formation is less than 6.0.

6. A process according to claim 1 further characterized in that the temperature of the dispersing medium during nucleation is in the range of from 20 to 80° C.

7. A process according to claim 1 further characterized in that a peptizer is present in the dispersing medium during nucleation in a concentration of from 20 to 800 grams per mole of silver.

8. A process according to claim 1 further characterized in that (a) the lipophilic alkylene oxide block units contain repeating units satisfying the formula:

$$-(\overset{R^9}{\overset{|}{C}}HCH_2O)-$$

where $R^9$ is a hydrocarbon of from 1 to 10 carbon atoms, and b) the hydrophilic alkylene oxide block linking unit contain repeating units satisfying the formula:

$$-(\overset{R^{10}}{\overset{|}{C}}HCH_2O)-$$

where $R^{10}$ is hydrogen or a hydrocarbon of from 1 to 10 carbon atoms substituted with at least one polar group.

9. A process according to claim 1 further characterized in that (a) grain nucleation is undertaken at a pAg in the range of from 7.0 to 10.0, at a temperature in the range of from 20° to 60° C., and in the presence of from 40 to 600 grams of a peptizer per mole of silver, (b) the polyalkylene oxide block copolymer satisfies the formula:

$$(H—LAO)_2—HOL—(LAO—H)_{z'}$$

where

LAO in each occurrence represents a terminal lipophilic alkylene oxide block unit, HOL represents a hydrophilic alkylene oxide block linking unit, z is 2 and z' is 1 or 2, (c) the concentration of the polyalkylene oxide block copolymer in the dispersing medium during twin plane formation is in the range of from 1 to 50 percent of the weight of silver present, (d) the molecular weight of the polyalkylene oxide block copolymer is in the range of from 1,100 to 50,000, (e) twin plane formation is undertaken at a pH of less than 6, (f) twin plane formation prior to ripening out a portion of the grains utilizes from 0.05 to 2.0 percent of the total silver used to form the emulsion, and (g) a silver halide ripening agent is used to ripen out a portion of the silver halide grain nuclei.

10. A process according to claim 9 further characterized in that the polyalkylene oxide satisfies the formula:

$$(H—LAO—HAO)_z—L—(HAO—LAO—H)_{z'}$$

where

HAO in each occurrence represents a hydrophilic alkylene oxide block unit,

LAO in each occurrence represents a terminal lipophilic alkylene oxide block unit, L represents an amine or diamine linking group, z is 2 and z' is 1 or 2.

11. A process according to claim 10 further characterized in that the polyalkylene oxide copolymer satisfies the formula:

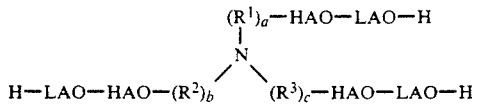

where $R^1$, $R^2$ and $R^3$ are independently selected hydrocarbon linking groups containing from 1 to 10 carbon atoms; and a, b and c are independently zero or 1.

12. A process according to claim 10 further characterized in that the polyalkylene oxide copolymer satisfies the formula:

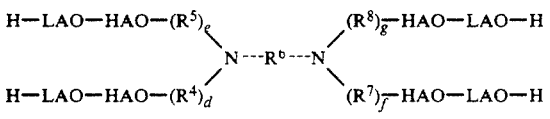

where $R^4$, $R^5$, $R^6$, $R^7$ and $R^8$ are independently selected hydrocarbon linking groups containing from 1 to 10 carbon atoms; and d, e, f and g are independently zero or 1.

13. A process according to any one of claims 10, 11 and 12 further characterized in that the H-LAO-HAO-units each satisfy the formula:

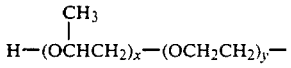

where x is in the range of from 3 to 250 and y is in the range of from 2 to 340.

14. A process according to claim 13 further characterized in that the hydrophilic alkylene oxide block linking unit constitutes from 20 to 90 percent of the polyalkylene oxide block copolymer.

15. A process according to claim 9 further characterized in that (a) grain nucleation is undertaken in the presence of a gelatino-peptizer containing at least micromoles of methionine per gram and (b) twin plane formation is undertaken at a pH of less than 3.0.

16. A process according to claim 15 characterized in that (a) the molecular weight of the polyalkylene oxide block copolymer is in the range of from 2000 to 30,000 and (b) the hydrophilic alkylene oxide block linking unit constitutes from 5 to 85 percent of the polyalkylene oxide block copolymer.

17. A process according to claim 9 further characterized in that (a) grain nucleation is undertaken in the presence of a gelatino-peptizer containing less than 30 micromoles of methionine per gram, (b) twin plane formation is undertaken at a pH of less than 5.5, (c) no iodide is added after the step of ripening out a portion of the silver halide grain nuclei.

18. A process according to claim 17 further characterized in that the gelatino-peptizer contains less than 12 micromoles of methionine per gram.

19. A process according to claim 17 further characterized in that (a) the molecular weight of the polyalkylene oxide block copolymer is in the range of from 1100 to 30,000 and (b) the hydrophilic alkylene oxide block linking unit constitutes from 4 to 35 percent of the polyalkylene oxide block copolymer.

20. A process according to claim 19 further characterized in that the lipophilic alkylene oxide block linking unit constitutes from 10 to 30 percent of the polyalkylene oxide block copolymer.

* * * * *